US006375204B1

(12) United States Patent
Tu

(10) Patent No.: US 6,375,204 B1
(45) Date of Patent: Apr. 23, 2002

(54) PITCHING SKATE BOARD

(76) Inventor: Wen-Wu Tu, No. 72, Ying-Hua Rd., Hsi-Tun Dist., Taichung (TW)

( * ) Notice: Subject to any disclaimer, the term of this patent is extended or adjusted under 35 U.S.C. 154(b) by 0 days.

(21) Appl. No.: 09/765,566

(22) Filed: Jan. 22, 2001

(51) Int. Cl.[7] ..... A63C 17/04
(52) U.S. Cl. ..... 280/87.042; 280/842; 280/11.27
(58) Field of Search ..... 270/87.042, 87.041, 270/87.021, 842, 11.221, 11.226, 11.227, 11.27, 11.28

(56) References Cited

U.S. PATENT DOCUMENTS 954,993 A * 4/1910 Peters ..... 280/11.221
2,166,767 A * 7/1939 Petermann ..... 280/11.226
2,220,557 A * 11/1940 User ..... 280/11.221
3,282,598 A * 11/1966 Goodwin ..... 280/87.041
3,622,172 A * 11/1971 Goodwin ..... 280/87.042
5,411,277 A * 5/1995 Pratt ..... 280/11.221
5,492,352 A * 2/1996 Clair ..... 280/87.042
5,601,299 A * 2/1997 Yun et al. ..... 280/87.042
5,673,941 A * 10/1997 Osawa ..... 280/842
5,823,544 A * 10/1998 Ellis et al. ..... 280/11.221
6,209,894 B1 * 4/2001 Walker, IV ..... 280/87.042

* cited by examiner

*Primary Examiner*—Michael Mar
(74) *Attorney, Agent, or Firm*—Rosenberg, Klein & Lee

(57) ABSTRACT

A skate board has a platform, at least one supporting frame integrally formed on a bottom surface of the platform and extending parallel to a longitudinal direction of the platform, and a plurality of wheel trucks fixed with the supporting frame. At least one plurality of assembly holes is defined in the supporting frame and a center of each hole follows a curved bottom end face of the supporting frame. Each one of the wheel trucks includes a wheel axle disposed substantially perpendicular to the longitudinal direction of the platform and extending through one of the plurality of assembly holes. At least two wheels are rotatably mounted on each wheel axle, whereby the skate board is intended to support a user operating in a pitching way to advance the skate board on the ground, so as to simulate sea surfing on the dry land.

10 Claims, 6 Drawing Sheets

PITCHING SKATE BOARD

BACKGROUND OF THE INVENTION

1. Field of the Invention

The present invention relates to a skate board, which is able to support a user operating the skate board to advance in a pitching way to simulate on dry land sea surfing.

2. Description of Related Art

A conventional skate board generally has a front and a rear wheel trucks respectively fixed on a bottom surface of a platform. Each one of the wheel trucks comprises a wheel axle and a pair of wheels rotatably mounted at opposite ends of the wheel axle. The wheels of the conventional skate board simultaneously roll on the ground. However the rolling motion of the conventional skate board often goes too smoothly and lacks variety, whereby riders quickly feel bored.

Therefore, it is an objective of the invention to provide an improved skate board to mitigate and/or obviate the aforementioned problems.

SUMMARY OF THE INVENTION

The main object of the invention is to provide a skate board, which is intended to support a user operating the skate board advancing in a pitching way. The skate board has a platform, at least one supporting frame integrally formned on a bottom surface of the platform and extending parallel to a longitudinal direction of the platform, and a plurality of wheel trucks fixed with the supporting frame and equally-spaced parallel to a curved bottom surface extending along the longitudinal direction of the platform. Wherein each one of the wheel trucks includes a wheel axle disposed substantially perpendicular to the longitudinal direction of the platform and extending through and fixed with the supporting frame. At least two wheels are rotatably mounted on each wheel axle. Whereby when the user supported on the skate board rides the skate board properly, the skate board advances in a pitching way to simulate on dry land sea surfing.

A further object of the invention is to provide a skate board, which further comprises a pair of rails secured on a top surface of the platform, whereby the skate board is also intended to support the user seated between the two rails on the platform. When the user swings his/her body on the skate board, the wheel trucks of the skate board roll on the ground in turn, and the skate board pitches from front to rear in response to the swinging of the user, such that the skate board is used as an exercise device for lumbar muscles.

Other objects, advantages and novel features of the invention will become more apparent from the following detailed description when taken in conjunction with the accompanying drawings

DETAILED DESCRIPTION OF THE PREFERRED EMBODIMENT

Figure 1:
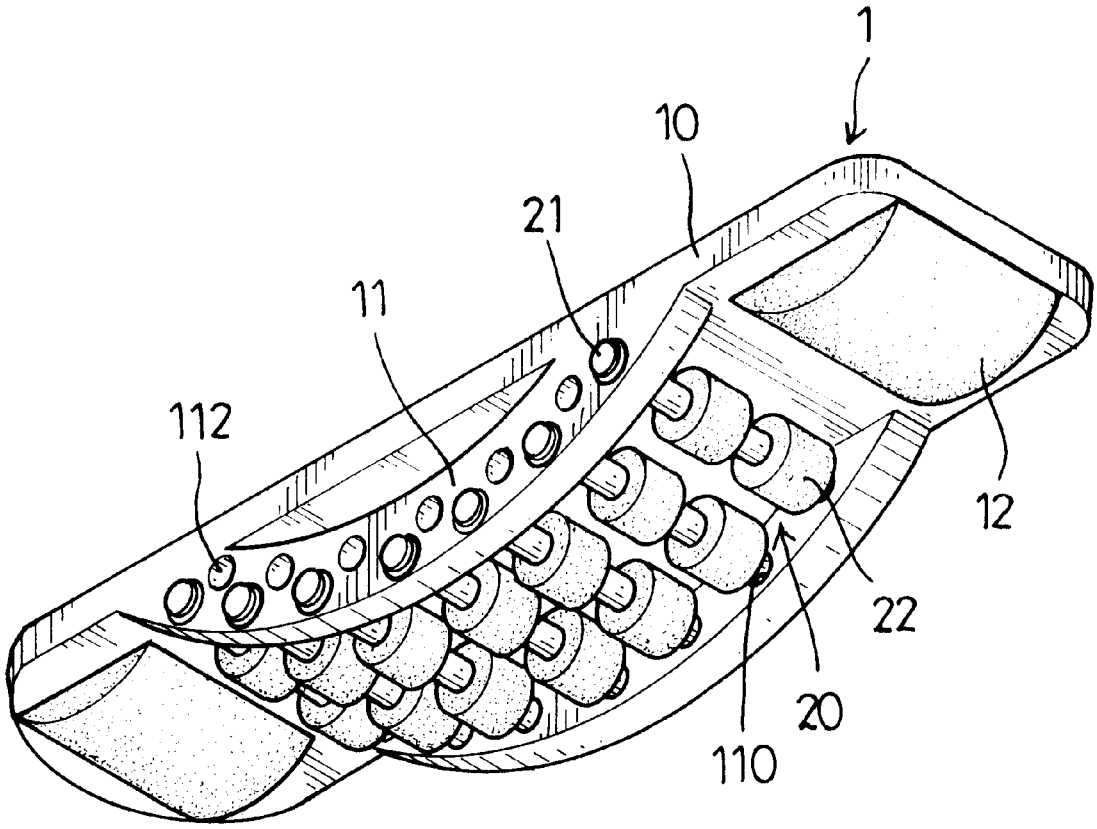
FIG. 1 is a perspective view of a first embodiment of a skate board in accordance with the invention.
Figure 2:
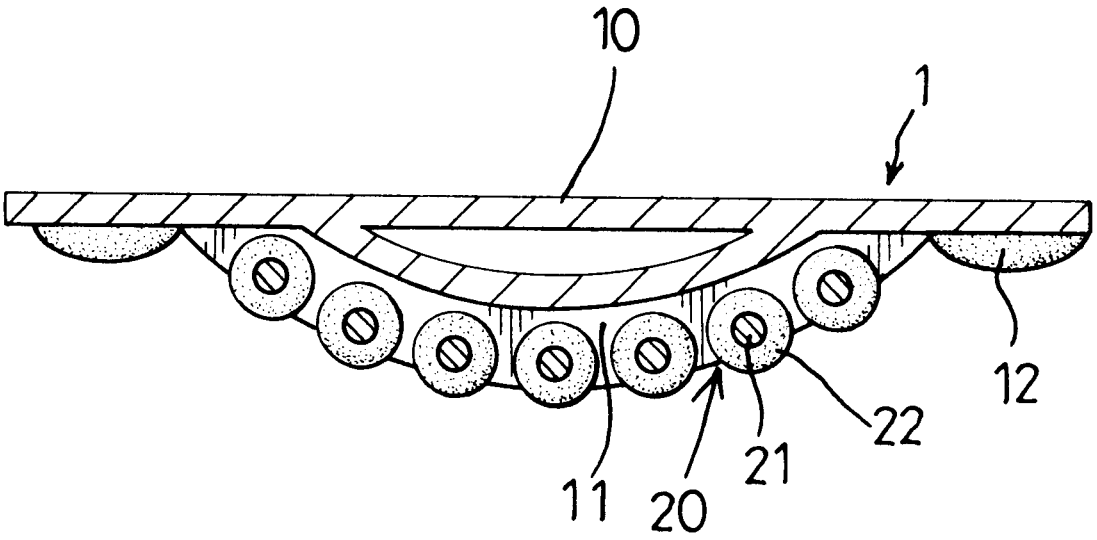
FIG. 2 is a cross sectional side view of the first embodiment of the skate board in accordance with the invention in assembly.

As shown in FIGS. 1 and 2, a first embodiment of a skate board (1) in accordance with the invention comprises a platform (10), two parallel supporting frames (11) integrally formed on a bottom surface of the platform (10), a plurality of wheel trucks (20) fixed with the supporting frames (11), and two brake blocks (12) respectively secured on the bottom surface near a front end and a rear end of the platform (10).

The supporting frames (11) are particularly formed with curved bottom end faces and are respectively extended parallel to a longitudinal direction of the platform (10). Each supporting frame (11) has a plurality of first assembly holes (110) defined therealong such that centers of the first assembly holes (110) are equal-distant from the curved bottom end faces of the supporting frames (11). The wheel trucks (20) fixed with the supporting frames (11) are equal-spaced on a first curve along the longitudinal direction of the platform (10), so that each two adjacent wheel trucks (20) are not equal spaced to the platform (10). A middle one of the wheel trucks (20) is farthest from the platform (10), and the remainder of the trucks (20) are spaced in respective pairs on either side of the middle one truck (20) in the first curve and gradually approach the platform (11). Each one of the wheel trucks (20) has a wheel axle (21) disposed substantially perpendicular to the longitudinal direction of the platform (10) and having opposite ends thereof respectively extended through an aligned pair of the first assembly holes (110). At least two wheels (22) are rotatably mounted on each wheel axle (21) between the two supporting frames (11). Each one of the supporting frames (11) is preferably defined with a second set of assembly holes (112), which are distributed along a second curve with a curvature different to the curvature of the first curve along which the wheel trucks (20) are arranged. Thus the second assembly holes (112) arranged in a different curvature are intended to permit re-assembly of the wheel trucks (20) to achieve for a rider a sensation different to that of the first assembly holes (110) of the first curve.

Figure 3:
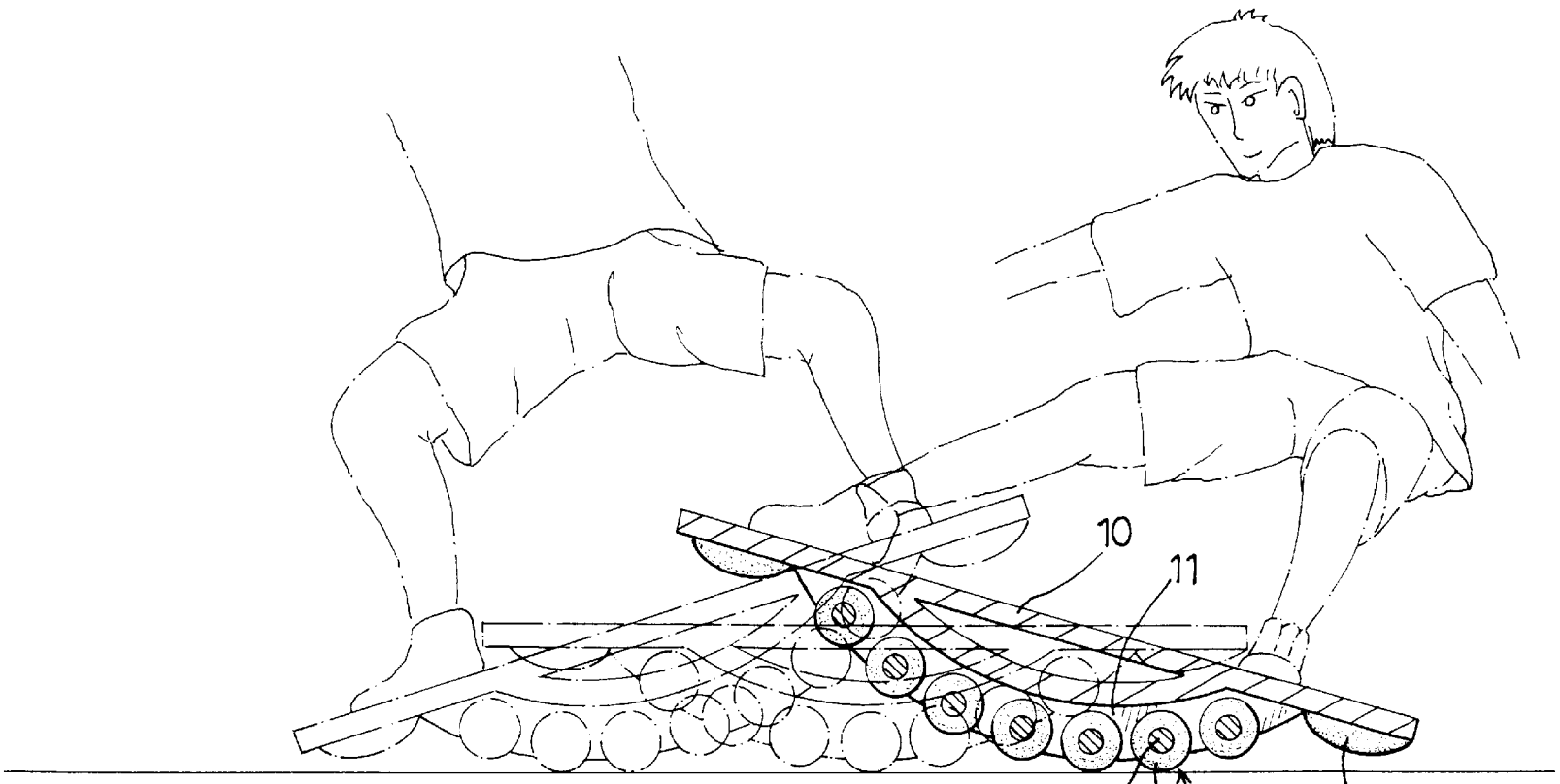
FIG. 3 is a schematic action view of the first embodiment of the skate board in accordance with the invention, showing an operator riding on the skate board.

When a user is standing on the skate board (1) as shown in FIG. 3, feet of the user are respectively positioned near the front and the rear ends of the platform (10), and the skate board (1) always has two adjacent wheel trucks (22) rolling along the ground. Because each two adjacent wheel trucks (22) are not equal spaced to the platform (10), by the swinging of the user's body to move the skate board (1) properly, the skate board (1) is advanced in a pitching way on the ground to simulate on dry land sea surfing. If the user's body is kept inclined at a fixed angle and two adjacent wheel trucks (22) are kept rolling on the ground continuously, the skate board (1) advances smoothly on the ground just like the conventional skate board does.

If the user wants to stop skating, he/she can just press down either end of the platform (10) to make one of the brake blocks (12) contact with the ground.

Figure 4:
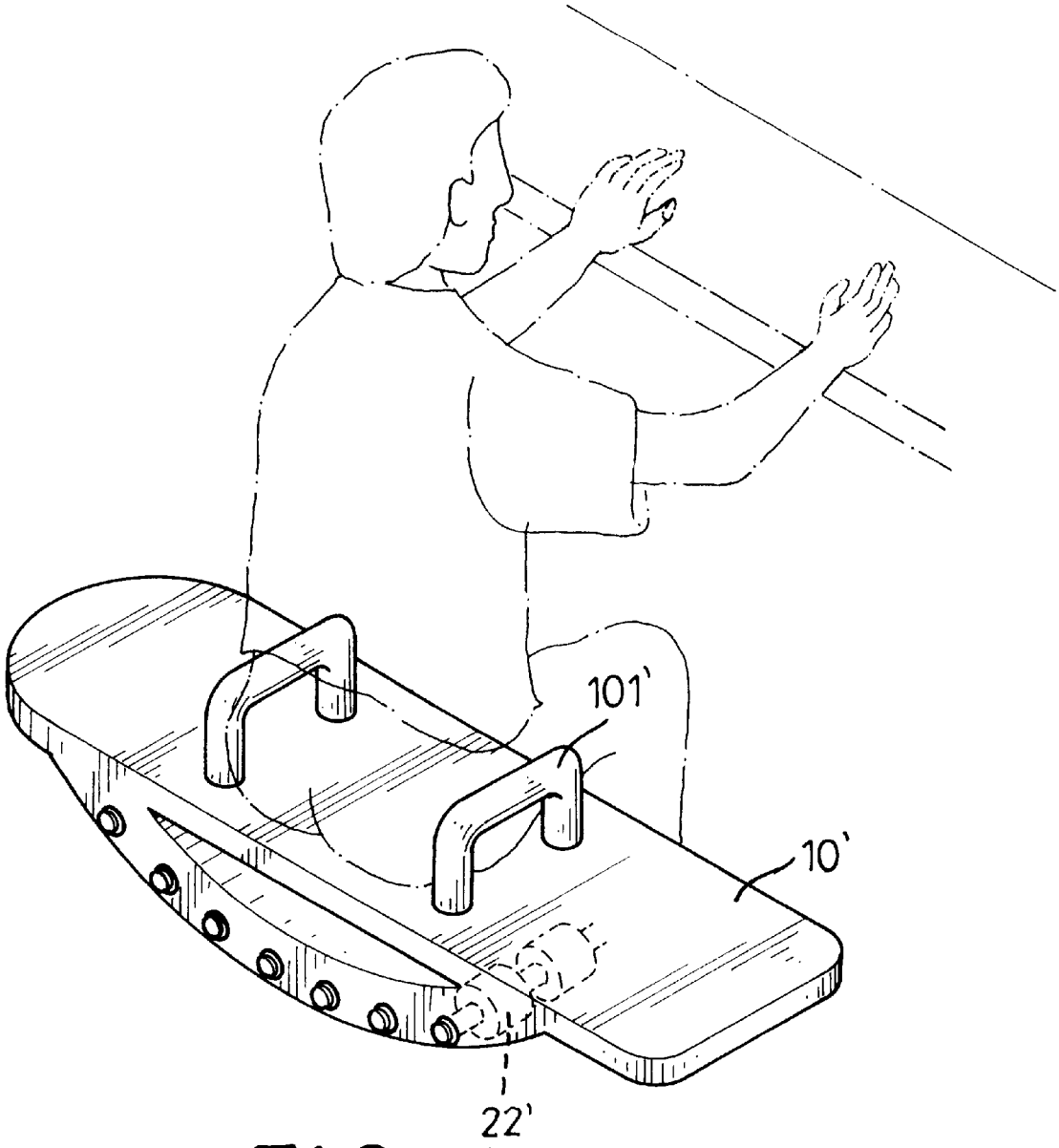
FIG. 4 is a perspective view of a second embodiment of the skate board in accordance with the present invention.
Figure 5:
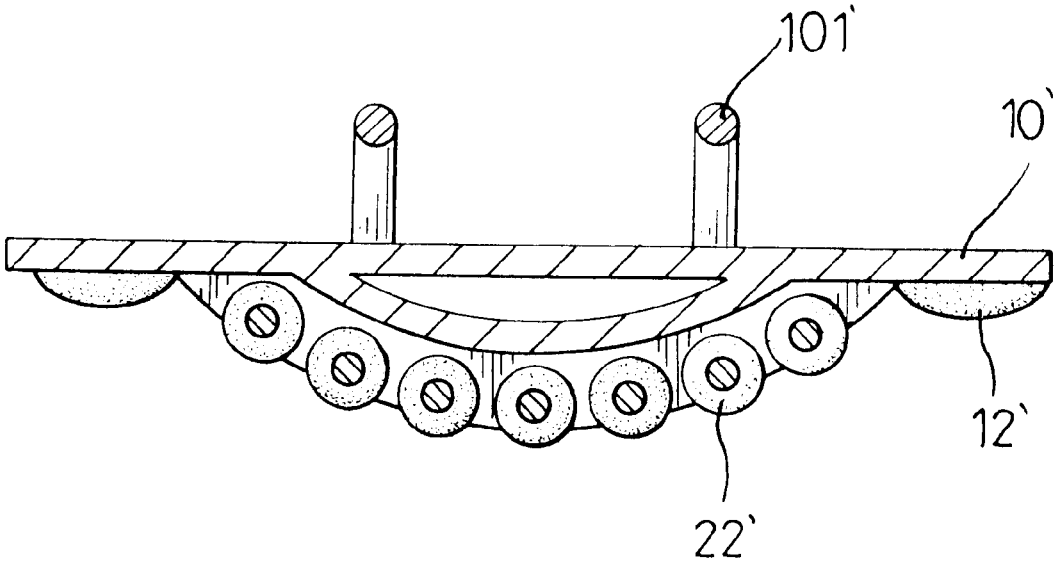
FIG. 5 is a cross sectional side view of the second embodiment of the skate board in accordance with the present invention.

With reference to FIGS. 4 and 5, a second embodiment of the skate board comprises a platform (10') having a pair of rails (101') secured on a top surface thereof. While the user is seated on the platform (10') between the two rails (101')

and swings his/her body, the wheel trucks (22') are respectively rolling along the ground, and the skate board pitches from the front end to the rear end in response to the swinging of the user. In such a way, the skate board is intended to be an exercise device for riders to exercise their lumbar muscles.

Figure 6:
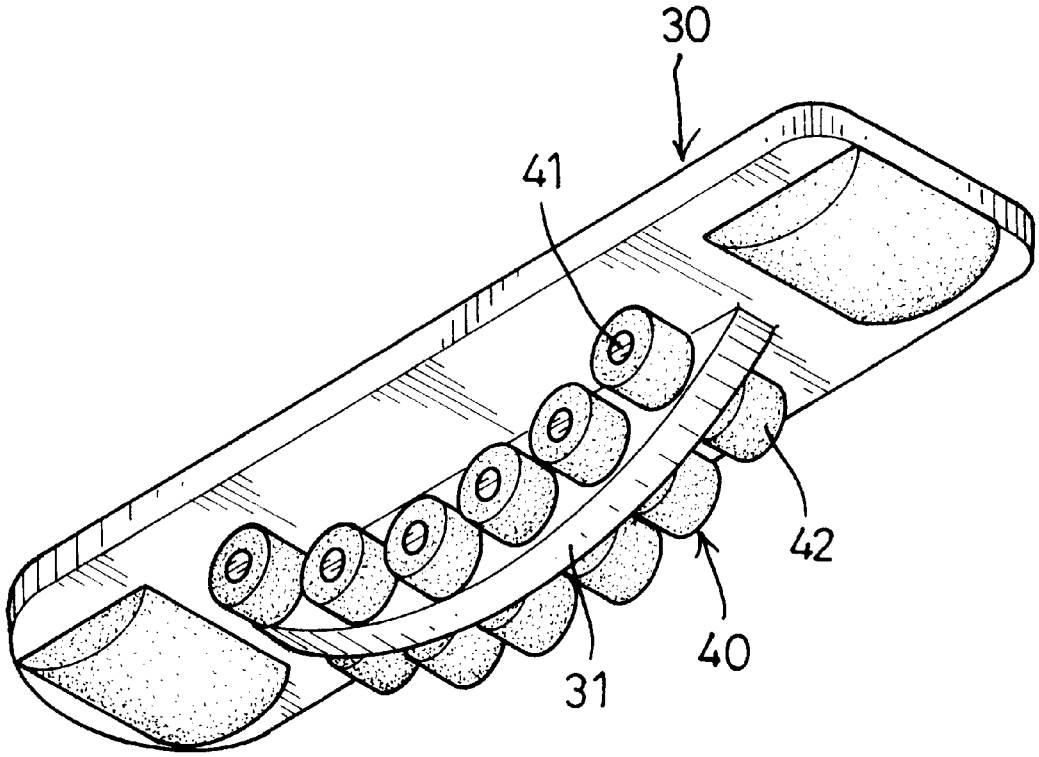
FIG. 6 is a perspective bottom view of a third embodiment of the skate board in accordance with the present invention.

FIG. 6 shows a third embodiment of the skate board, which comprises a platform (30), a single supporting frame (31) integrally formed at center of a bottom surface of the platform (30), and a plurality of wheel trucks (40) fixed with the supporting frame (31). Each one of the wheel trucks (40) includes a wheel axle (41) extended through one of a third plurality of assembly holes (114) and fixed with the supporting frame (31), and two wheels (42) respectively and rotatably mounted at opposite ends of the wheel axle (41). Although the structure of the third embodiment of the skate board has a little difference to the structure of the first and second embodiments, they are all designed in conformity with same principle and spirit of the invention.

From the above description, it is noted that the invention has a novel operating style which provides challenges and excitement to consumers.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the fill extent indicated by the broad general meaning of the terms in which the appended claims are expressed.

What is claimed is:

1. A pitching skate board apparatus comprising:

a platform having front and rear end portions and an intermediate portion extending longitudinally therebetween, said platform being configured for supporting both feet of a user in a longitudinally spaced manner;

at least one protrusive supporting frame protruding downward from a bottom surface of said intermediate portion of said platform and extending longitudinally between said front and rear end portions of said platform, said supporting frame having a bottom end face portion describing a continuous arcuate bulbous profile along an entire length thereof, said supporting frame having formed therein a plurality of first assembly holes arranged in equidistant manner relative to said bottom end face portion; and, a plurality of wheel trucks coupled to said supporting frame, each said wheel truck including at least one wheel axle engaging at least one said first assembly hole, and at least a pair of wheels coaxially disposed on said wheel axle, said wheel trucks being disposed sequentially along said arcuate bulbous profile;

whereby said platform is displaceable in a rocking manner about a reference defined by said arcuate bulbous profile responsive to user actuation thereof.

2. The pitching skate board apparatus as recited in claim 1 comprising a pair of said supporting frames extending from said bottom surface of said platform intermediate portion, said supporting frames being disposed substantially in parallel, said wheel trucks each extending between said supporting frames, each said wheel truck including said wheels coaxially disposed on one said wheel axle.

3. The pitching skate board apparatus as recited in claim 1 wherein each said wheel truck includes said wheels coaxially disposed on one said wheel axles, said wheels being disposed on opposing sides of said supporting frame.

4. The pitching skate board apparatus as recited in claim 1 wherein at least one brake block is secured to at least one of said front and rear end portions of said platform.

5. The pitching skate board apparatus as recited in claim 1 wherein first and second brake blocks are respectively secured to bottom surfaces of said front and rear end portions of said platform.

6. The pitching skate board apparatus as recited in claim 1 wherein said supporting frame has formed therein a plurality of second assembly holes distributed along a second arcuate bulbous profile for alternative respective engagement by said wheel axles of said wheel trucks in an alternative configuration.

7. The pitching skate board apparatus as recited in claim 1 further comprising a pair of rails secured to a top surface of said platform.

8. The pitching skate board apparatus as recited in claim 4 wherein said brake block is secured to a bottom surface of said front end portion of said platform.

9. The pitching skate board apparatus as recited in claim 4 wherein said brake block is secured to a bottom surface of said rear end portion of said platform.

10. The pitching skate board apparatus as recited in claim 1 wherein adjacent ones of said wheel trucks are disposed in longitudinally spaced manner one relative to the other.

* * * * *